US010643273B2

(12) United States Patent
Trindade de Sousa Monteiro

(10) Patent No.: US 10,643,273 B2
(45) Date of Patent: May 5, 2020

(54) METHOD AND SYSTEM FOR PERFORMING ACTIONS OF AN AUCTION OF A PRODUCT OR SERVICE THROUGH A COMMUNICATION NETWORK

(71) Applicant: Luciano Trindade de Sousa Monteiro, Cidade Monções (BR)

(72) Inventor: Luciano Trindade de Sousa Monteiro, Cidade Monções (BR)

( * ) Notice: Subject to any disclaimer, the term of this patent is extended or adjusted under 35 U.S.C. 154(b) by 533 days.

(21) Appl. No.: 14/846,434

(22) Filed: Sep. 4, 2015

(65) Prior Publication Data

US 2016/0314524 A1 Oct. 27, 2016

(30) Foreign Application Priority Data

Apr. 27, 2015 (BR) ..... 102015009454

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC ..... G06Q 30/08
USPC ..... 705/27
See application file for complete search history.

(56) References Cited

U.S. PATENT DOCUMENTS 6,598,029 B1 * 7/2003 Johnson ..... G06Q 10/04 376/215
6,691,094 B1 * 2/2004 Herschkorn ..... G06Q 30/0611 705/26.4
7,330,826 B1 * 2/2008 Porat ..... G06Q 30/0601 705/26.3
2001/0042041 A1 * 11/2001 Moshal ..... G06Q 30/06 705/37

(Continued)

OTHER PUBLICATIONS

Patent Agency Reviews Patent Application Approval Request for Fantasy Sport Auction Draft Application, Computer Weekly News, Oct. 31, 2013; Dialog #1444052977, 6ogs. (Year: 2013).*

*Primary Examiner* — Robert M Pond
(74) *Attorney, Agent, or Firm* — BakerHostetler

(57) ABSTRACT

A method for performing actions of an auction of a product or service through a communication network including sending to a plurality of sellers product or service specifications with an upset price wherein the plurality of sellers present a plurality of offers in homogenous manner for auction; receiving the plurality of offers; storing the plurality of offers in a database of communication network; receiving, from a plurality of buyers, purchase proposals for the product or service, the proposals being determined for each of the offers of the plurality of sellers; storing purchase proposals in the database; processing the purchase proposals and determining a plurality of lots, each of the lots of the plurality of lots being constituted by the plurality of purchase proposals received for each of the offers of the plurality of offers; and monitoring the moment when one of (Continued)

the sellers of the plurality of sellers buys a respective lot of the plurality of lots thereby defining the opportune moment, in the course of the auction, the price range of his interest to sell the product or service to the plurality of buyers who has given the plurality of purchase proposals in the respective lot bought.

42 Claims, 12 Drawing Sheets

(56) References Cited

U.S. PATENT DOCUMENTS

2007/0244797 A1* 10/2007 Hinson ..... G06Q 30/08
705/37
2012/0265634 A1* 10/2012 Kinney ..... G06Q 30/06
705/26.4

* cited by examiner

| | | |
|---|---|---|
| Reference Price - Maximum Purchase Proposal | 37 | 36 |
| Minimum Upset Price Proposal | 32 | |

Adjust after Bonus Algorithm (PRmin)+((1-B%)*(PRL- PRmin))

For Purchase Proposal Minimum value = 32, Qt. 4,
and Variations according to % Bonus.

| Ranges | 0% | 10% | 30% | 50% | 75% | 100% |
|---|---|---|---|---|---|---|
| 36 | 36 | 35.6 | 34.8 | 34.0 | 33 | 32 |
| 35 | 35 | 34.7 | 34.1 | 33.5 | 32.75 | 32 |
| 34 | 34 | 33.8 | 33.4 | 33 | 32.5 | 32 |
| 33 | 33 | 32.9 | 32.7 | 32.5 | 32.25 | 32 |
| 32 | 32 | 32 | 32 | 32 | 32 | 32 |
| 31 | | | | | | |
| 30 | | | | | | |
| $ Total Lot > | 135 | 134.3 | 132.9 | 131,5 | 129,75 | 128 |
| Average Price > | 33.75 | 33.575 | 33.225 | 32.875 | 32.437 | 32 |

Fig. 4

METHOD AND SYSTEM FOR PERFORMING ACTIONS OF AN AUCTION OF A PRODUCT OR SERVICE THROUGH A COMMUNICATION NETWORK

This application claims the priority of Brazilian patent case N°. BR102015009454-0 filed on Apr. 27, 2015, the content thereof being hereby incorporated by reference.

The present invention relates to a system and a method for performing actions of an auction for selling a product or service through a communication network, the auction being controlled by a managing system that defines the specifications of the product or service and a reference price, sends them to sellers that will present, in homogeneous form of specification and price, products or services for auction on the Internet, where the potential buyers, after having been registered, will make bids on the products in price ranges defined by the administrator, wherein the bids may be equal or differentiated by each product or service to each seller. The bids made by the buyers are accumulated by ranges in the database, and the product or service will be purchased in lots from a lowest price by one of the suppliers at the moment when he considers a lot to be attractive. Additionally and in parallel, related services that are complementary to the products will also be offered by the suppliers of services of types, such as financial, insurance services, etc., also offered in the form of lots, but in this case hired by the buyers, and these services will complementarily serve as operation guarantee of a transaction carried out.

DESCRIPTION OF THE PRIOR ART

An auction is a mode of negotiation that is widely used by both public bodies and private companies, the objective of which is to solve, in a simple, rapid and more competitive manner, the purchase or sale of products or services.

Auctions that have their origin in the physical market are restricted to areas such as the market of arts, and some others due to the difficulty of grouping all the potential sellers, but chiefly a majority of potential buyers, for a broad offer and purchase in the transaction of goods and services. With the advent of the Internet, auctions have become popular, exactly because they can aggregate and increase the number of potential sellers and buyers.

The electronic auctions over the Internet have been increasing around the world, enabling the use, on many markets, of products and services that are unviable on the physical auction markets. One can see that such a characteristic results in much wider opportunities of different trade and business between companies and people.

One can see that electronic auctions made available on the Internet, and also the patents referring to this subject, are characterized by transpositions of concepts from the physical medium to the Internet or electronic medium, the most widely known auction nowadays being carried out by offering a product or service having an upset price, wherein the parties interested in acquiring the product or service should make bids having higher values than the upset price. One observes that the buyers dispute with each other the acquisition of the product or service, the purchase being made on the basis of the highest bid made.

In this system, one can see that, in general, in a competition between buyers, which results in a dispute with another buyer, often leads the winner to pay a price above the market of the product or service. This type of auction has been carried out over the Internet at sites such as eBay and the Mercado Livre.

Another known auction system is the Dutch auction. At this type of auction, unlike the conventional auction, a maximum price for the product or service is determined. In this system, the price is reduced at predetermined intervals of time, until one of the buyers agrees to purchase the product or service. If none of the bidders buys the product or service, the price will continue to be reduced until it reaches a minimum reserve price, which is the minimum price for which the seller accepts to sell the product or service.

A system and a method for making an auction in which the price of the product on sale decreases as time goes by is disclosed in patent application BR505496-6. According to the teaching of said document, the price of the product or service is dynamic, so that the latter will reach the lowest market price through a defined and automatic variation, more specifically the prices are dynamic as a function of the interests of offer and demand and comes close to the market price.

In the case of the above-mentioned auction systems, as well as the auctions over the Internet and referred to in patents, there is an offer of sale, and the dispute between buyers, which is individual in most cases, over a desired object, in this case a product or service, this competition of the buyers on the basis of "the highest-bidder-takes-it" tends to lead a buyer to pay a price higher than the market price of the product or service which he wishes to acquire.

Thus, one cannot see, in the prior art, be it on the Internet or in patents, a system and a method for performing actions of an auction of a product or service where there is a competition of the seller for disputing an object of desire, in this case a lot constituted by proposals of purchase made by the buyers for a homogeneous product or service. This condition that the sellers dispute the buyers has a tendency to reduce the price of the goods and services to the level close to the real cost price, inasmuch as the sellers are aware of this cost price, information which is unknown to the buyers. Then a dynamic situation arises, wherein the effective result of a price reduction attracts to this market many more buyers, and since there are more buyers it attracts many other sellers, which results in a perfect market.

Objectives of the Invention

The present invention has not been developed from the characteristics of the physical environment auctions transposed to the electronic or Internet environment, but rather from the definition of a perfect market, which consists of:

I) existence of a large number of sellers and buyers, where the individual decision of each will have little influence on the global market;

II) existence of homogeneity of the product or service, where all the products or services are equal or similar to all the sellers;

III) existence of transparency, wherein the participants have full knowledge of the general conditions in which the market operates;

IV) existence of free and broad access to information; and

V) the buyer is in a condition to differentiate the price for the sellers whom he preferred or trust.

Making all these points viable and integrated in an optimized manner, which are only possible with the advent of the Internet and the use of technology for processing data and making information available, has then defined the objectives set forth below.

A first objective of the present invention is to provide a system and a method for performing actions of an auction of a product or service, wherein a seller competes with other sellers and takes any lot purchase proposal(s) made by the buyers, when the seller considers it attractive.

A second objective of the present invention is to provide a system and a method for performing actions of an auction of a product or service, wherein the lot is considered attractive when it comprises a determined volume of proposals made by the buyers, the latter being within the range considered attractive to the seller.

A third objective of the present invention is to provide a system and a method for performing actions of an auction of a product or service where a buyer in the face of offers of different sellers can make equal, differentiated bids or even make no bid for a product being offered by a seller that does not interest him.

A fourth objective of the present invention is to provide a system and a method for performing actions of an auction of a product or service where the sellers and the buyers have the guarantees of carrying out the transaction in conformity with the respective bids made.

A fifth objective of the present invention is to provide a system and a method for performing actions of an auction of a product or service where the administrator of the system defines a bonus factor (percent), so as to approximate the value of the highest bid range to the value of the lowest bid range taken by the seller, so that everybody will proportionally benefit from the lowest value of the range taken by the seller.

A sixth objective of the present invention is to provide a system and a method for performing actions of an auction of a product or service where the guaranties relating to the transaction are also presented by offers in lot by suppliers of service, such as financing and insurance relating to the products being traded.

BRIEF DESCRIPTION OF THE INVENTION

The objectives of the present invention are achieved by means of a method for performing actions of an auction of a product or service through a communication network which comprise:

- sending to a plurality of sellers the specifications of the product or service with a reference price, so that the plurality of vendors will present a plurality of offers in a homogeneous manner, to be put up for auction;
- receiving from a plurality of sellers the plurality of offers for the product or service to be sold at auction;
- storing the plurality of offers in a database of the communication network;
- receiving from a plurality of buyers a plurality of purchase proposals for the product or service, the plurality of purchase proposals being determined for each of the offers of the plurality of offers;
- storing the plurality of purchase proposals in the database of the communication network;
- processing the plurality of purchase proposals and determining a plurality of lots, each of the lots of the plurality of lots being constituted by the plurality of purchase proposals received for each of the offers of the plurality of offers; and
- monitoring the moment when one of the sellers of the plurality of sellers takes the respective lot of the plurality of lots, the seller of the plurality of sellers who takes the lot assuming the commitment to sell and supply the product or service to the plurality of buyers who made the plurality of purchase proposals in the respective lot taken.

The objectives of the present invention are further achieved by means of a system for performing actions of an auction of products or services through a communication network comprising a plurality of buyers and a plurality of sellers, the plurality of buyers and the plurality of sellers being connected to each other by means of the communication network, the communication network being configured to receive from the plurality of sellers a plurality of offers to the product or service and a plurality of purchase proposals from the plurality of buyers for each offer of the plurality of offers for the product or service, the communication network being further configured to store, in a database, the plurality of offers and the plurality of purchase proposals, the communication network processing the plurality of purchase proposals and determining a plurality of lots constituted by the plurality of purchase proposals received for each product or service offered, the communication network compiling, in real time so as to group the whole plurality of purchase proposals, the plurality of buyers for each offered product or service for each of the sellers of the plurality of sellers, so that one of them can take the respective lot, in the range that defines, as attractive or acceptable, so that one will decide at any moment to take the respective lot, the communication network monitoring in real time the taking of the respective lot by one of the sellers of the plurality of sellers that takes the respective lot.

BRIEF DESCRIPTION OF THE FIGURES

The present invention will now be described in greater detail with reference to an example of embodiment represented in the drawings. The figures show:

FIG. 4 is a demonstration of the bonus system with the simulation of application of different bonus percentages; in particular illustrates the bonus system with the simulation of application of different bonus percentages.

DETAILED DESCRIPTION OF THE INVENTION

Figure 1:
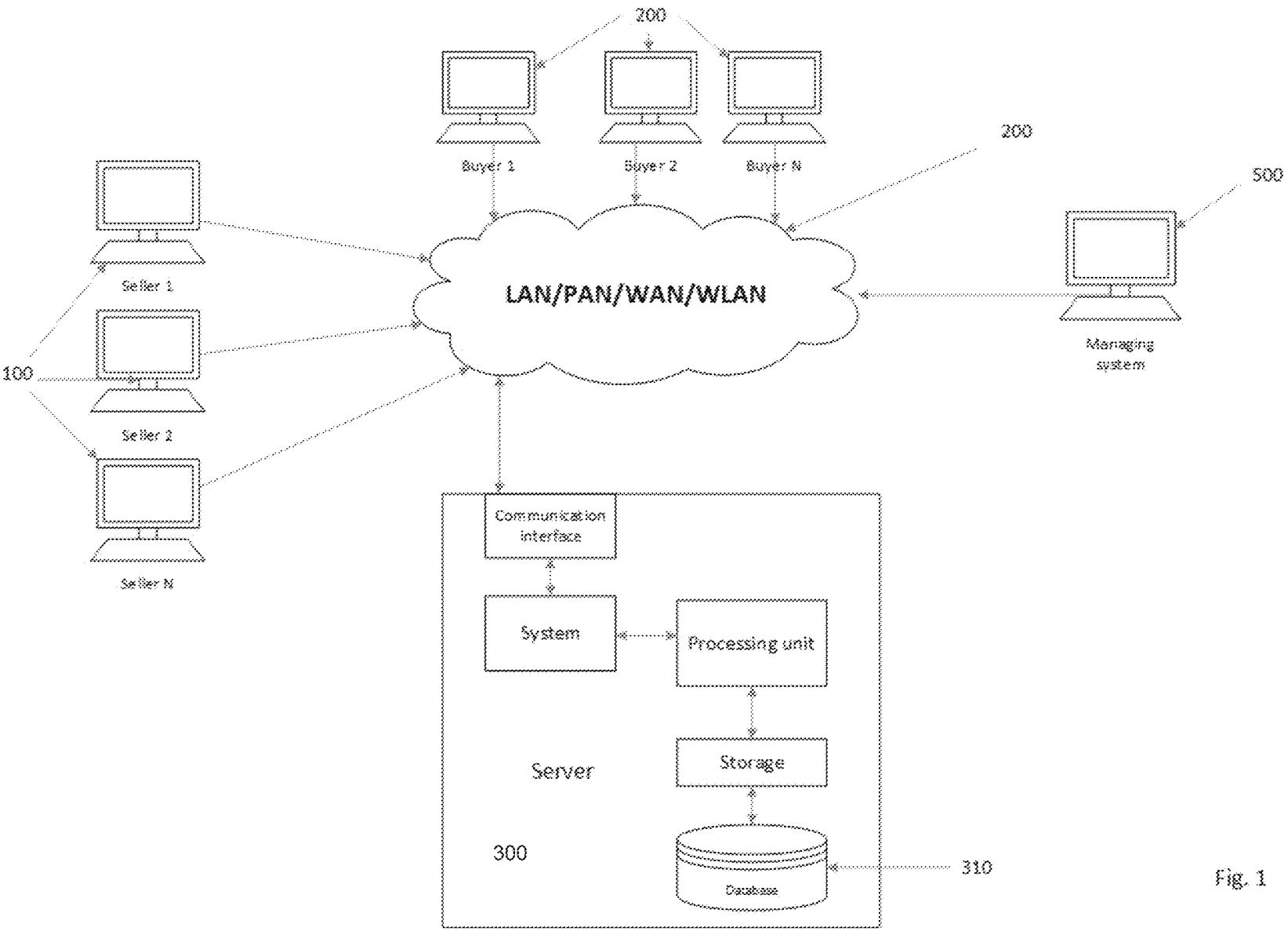
FIG. 1 is a schematic configuration of communication of the auction system as proposed by the present invention.
Figure 2:
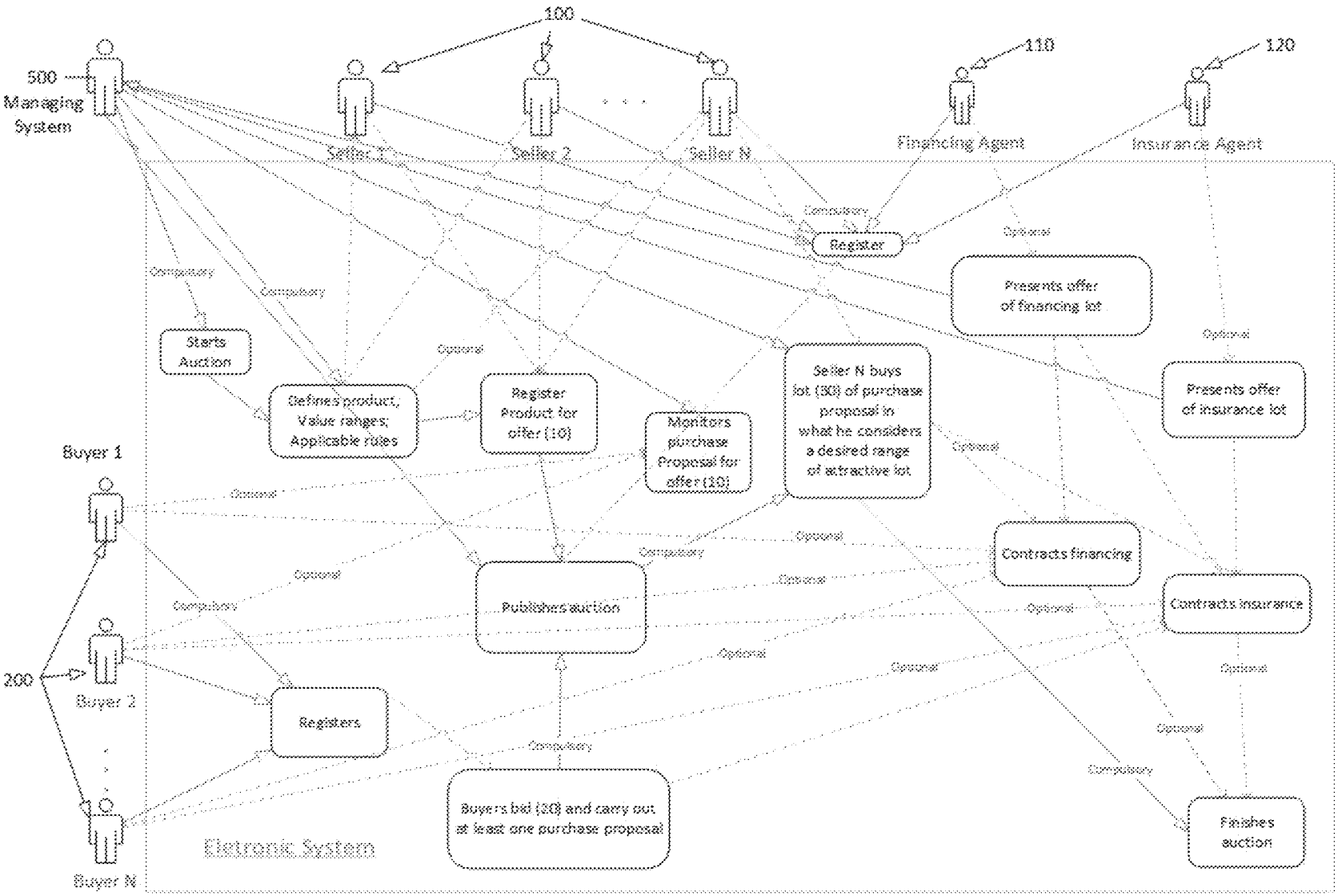
FIG. 2 is a basic structure of simulation of the auction as proposed by the present invention.
Figure 3:
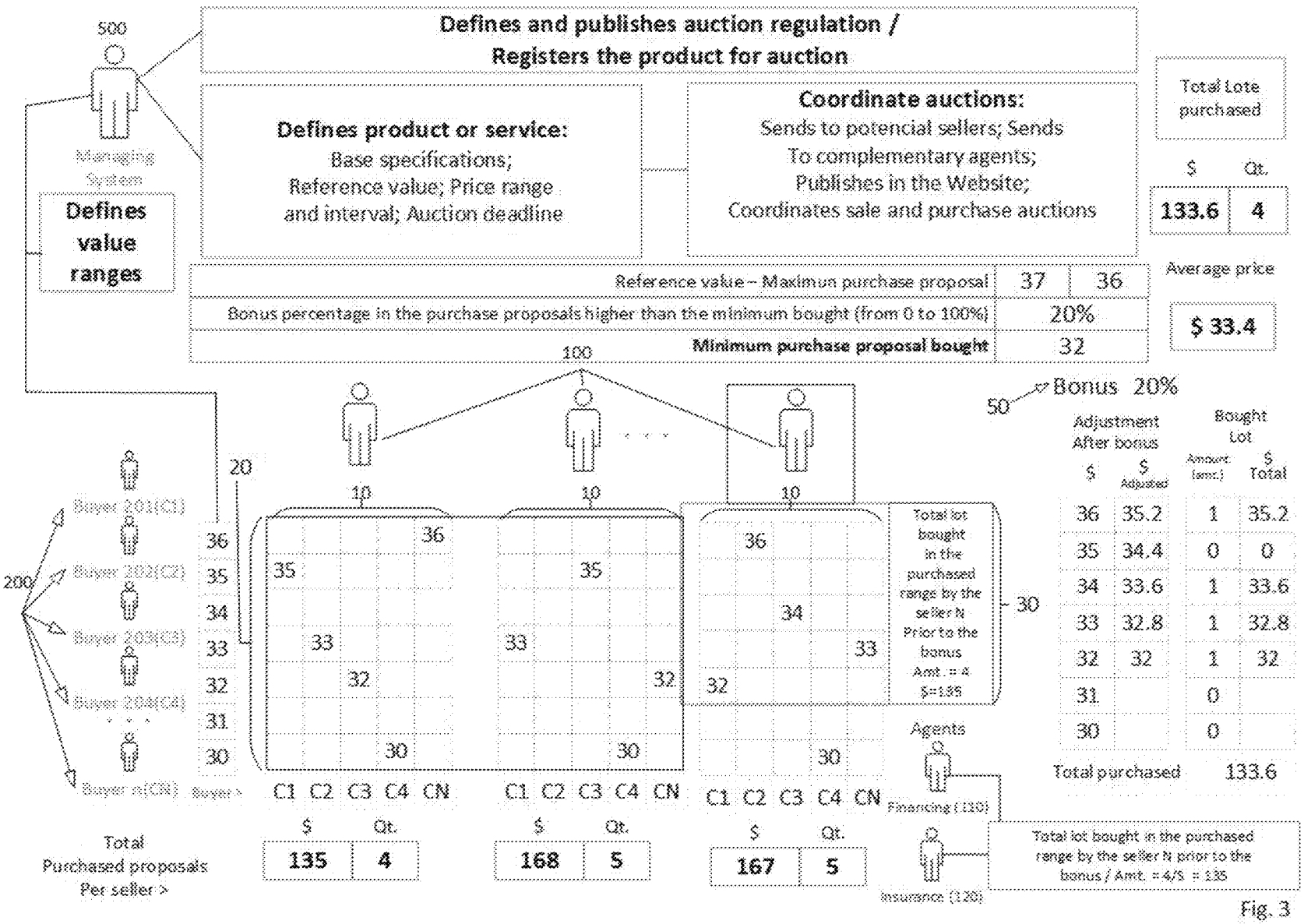
FIG. 3 is a simulation of the auction as proposed by the present invention, wherein the purchase proposals made by the buyers are shown in detail and the simulation of the application of the bonus factor.
Figure 5:
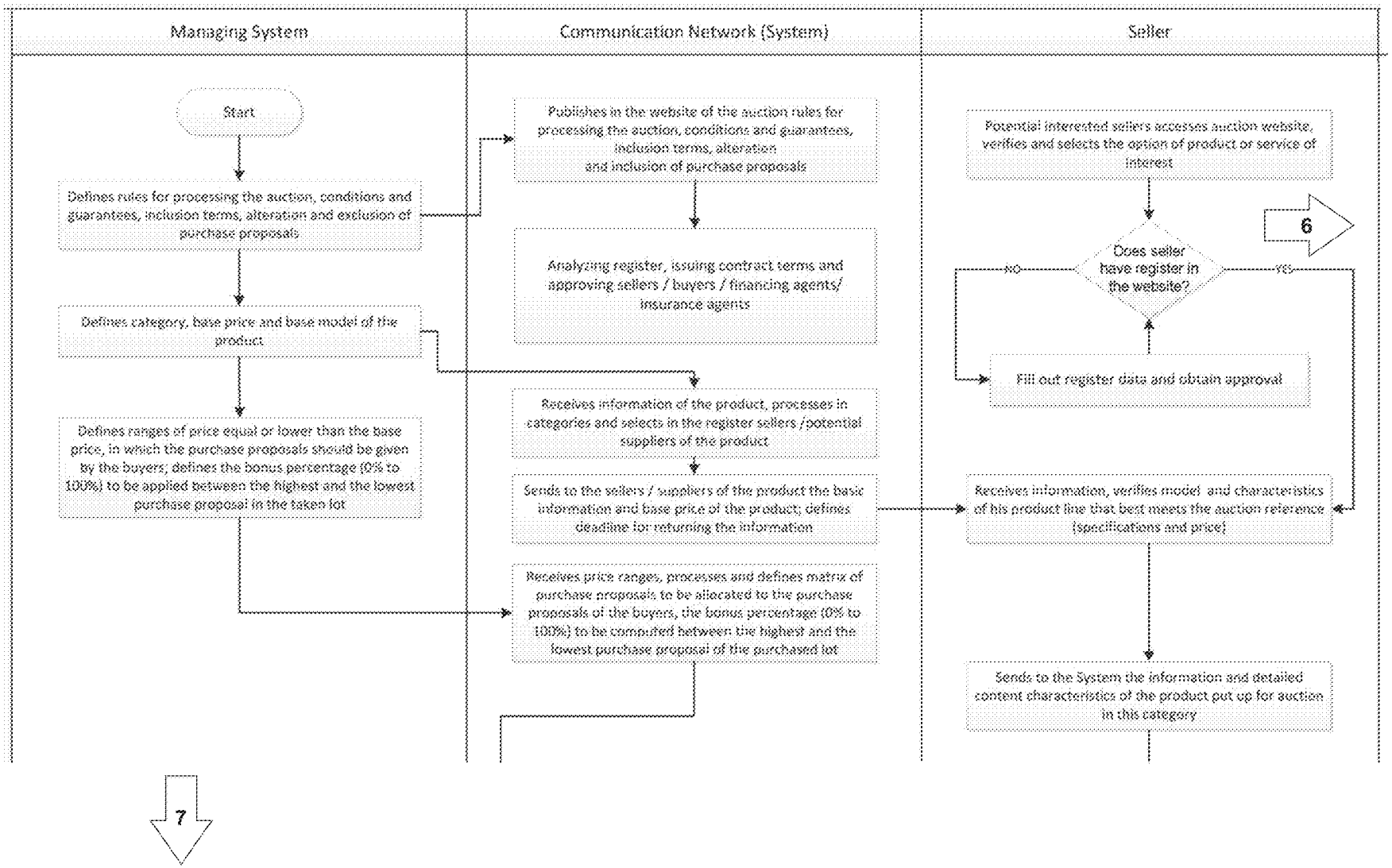
FIGS. 5 to 12 show a detailed multifunctional flowchart of the processing of the auction.
Figure 6:
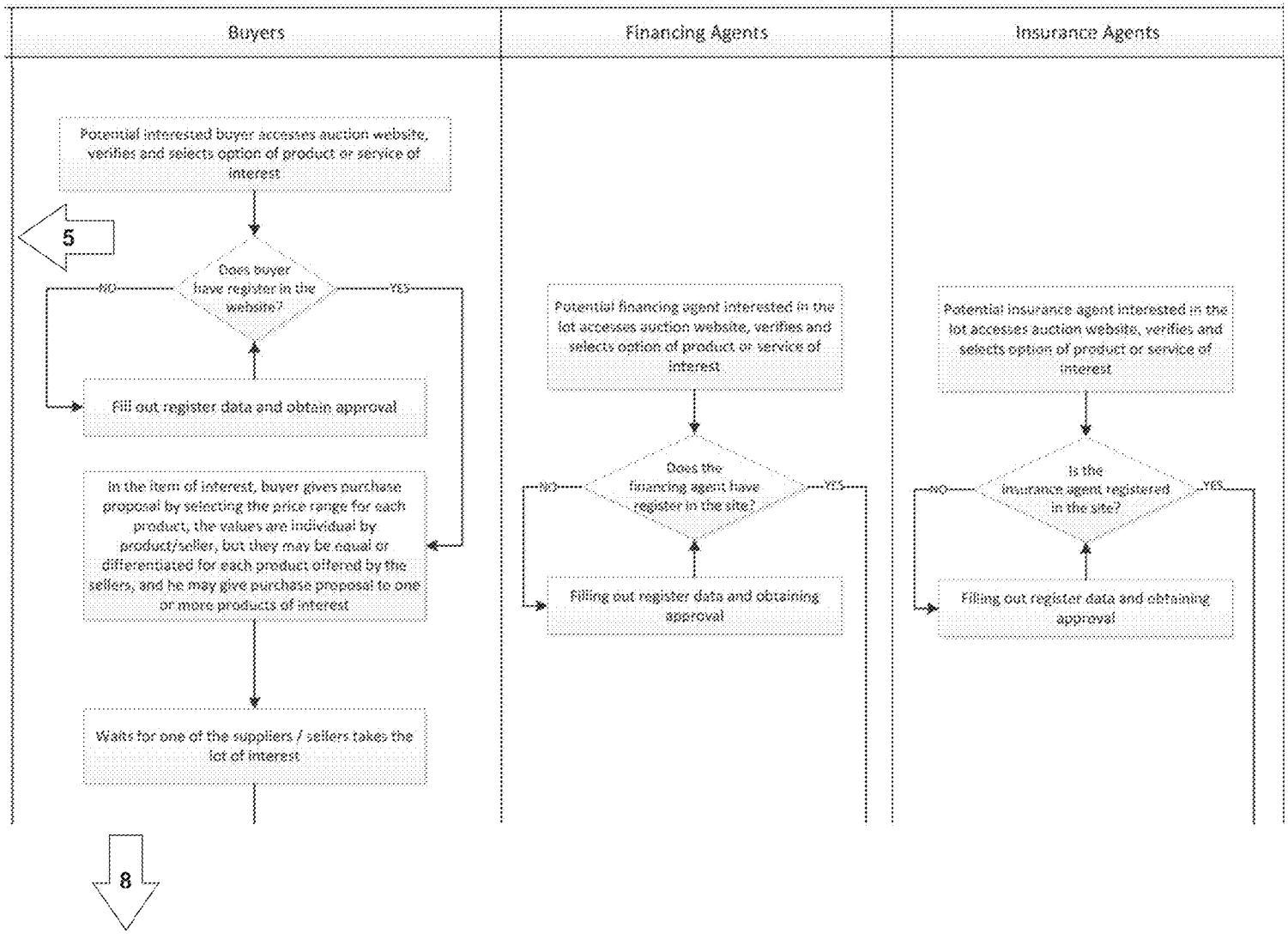
Figure 7:
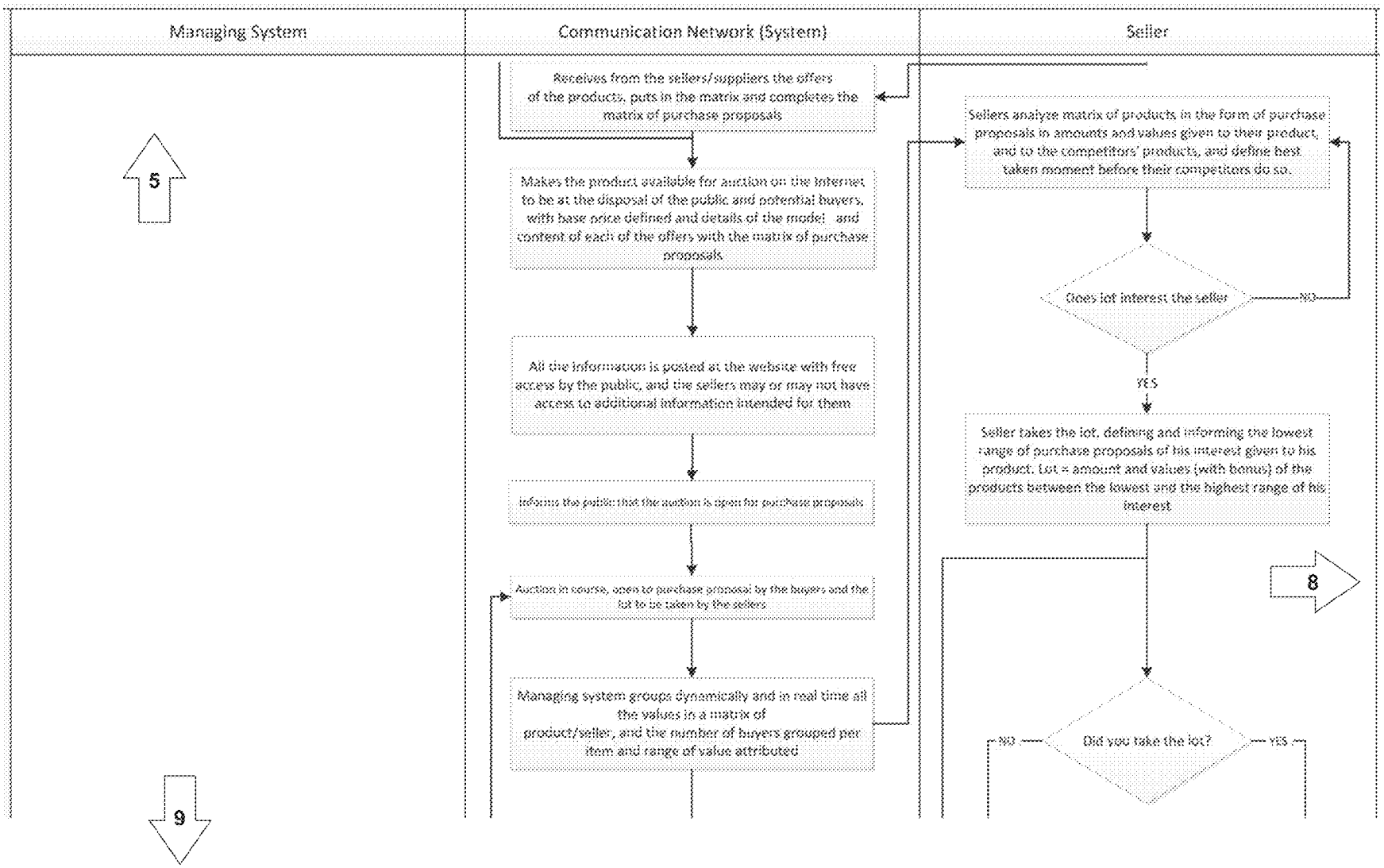
Figure 8:
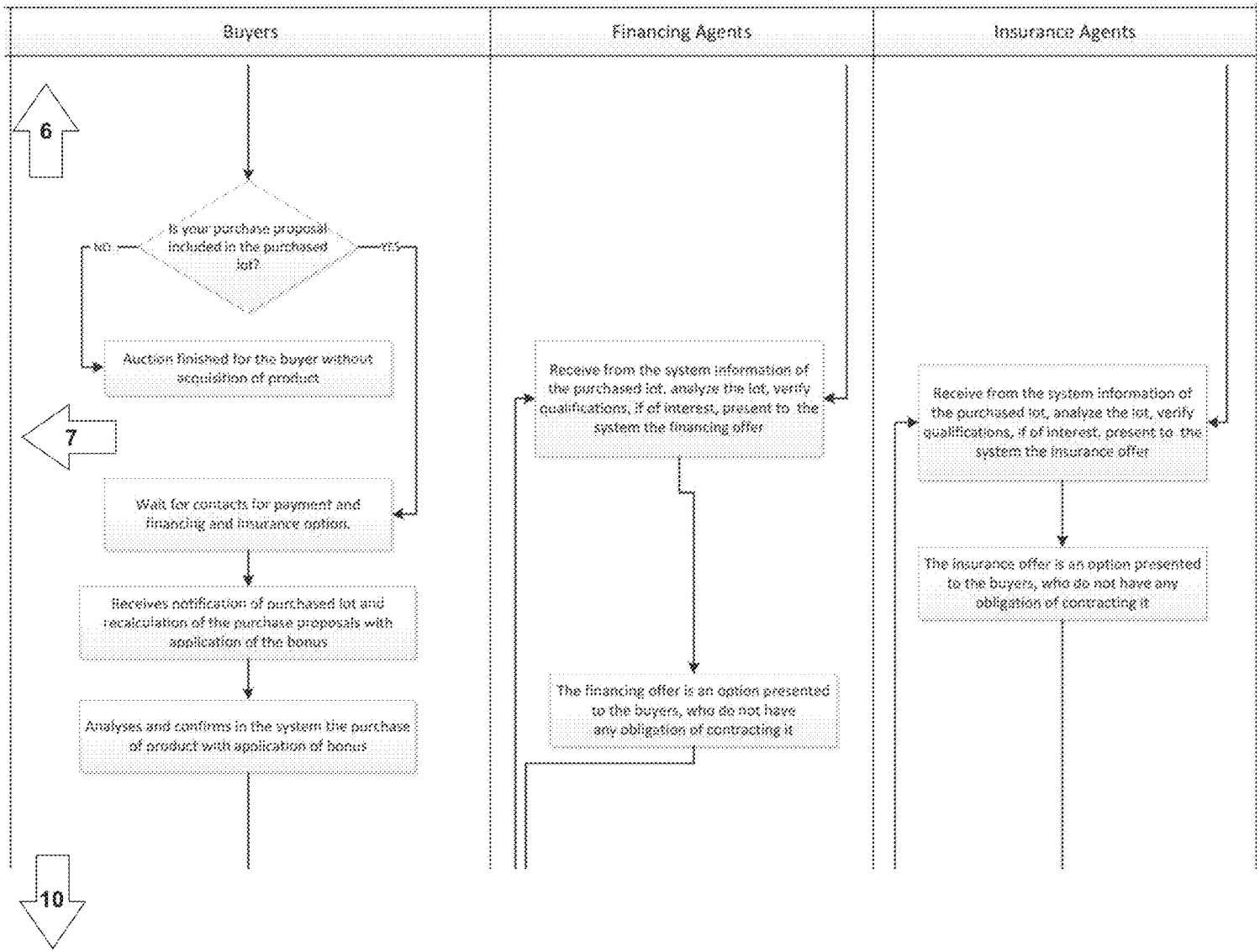
Figure 9:
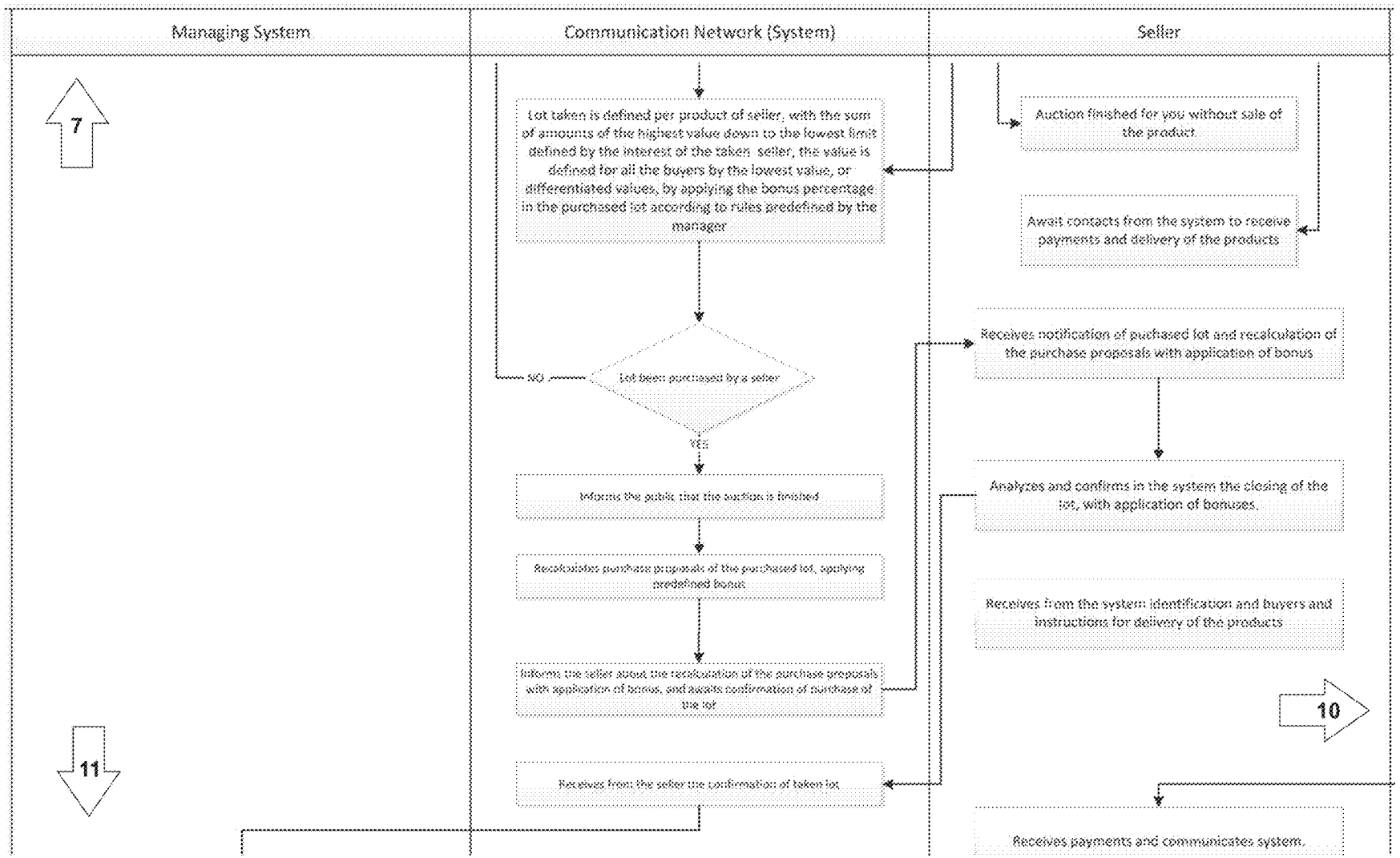
Figure 10:
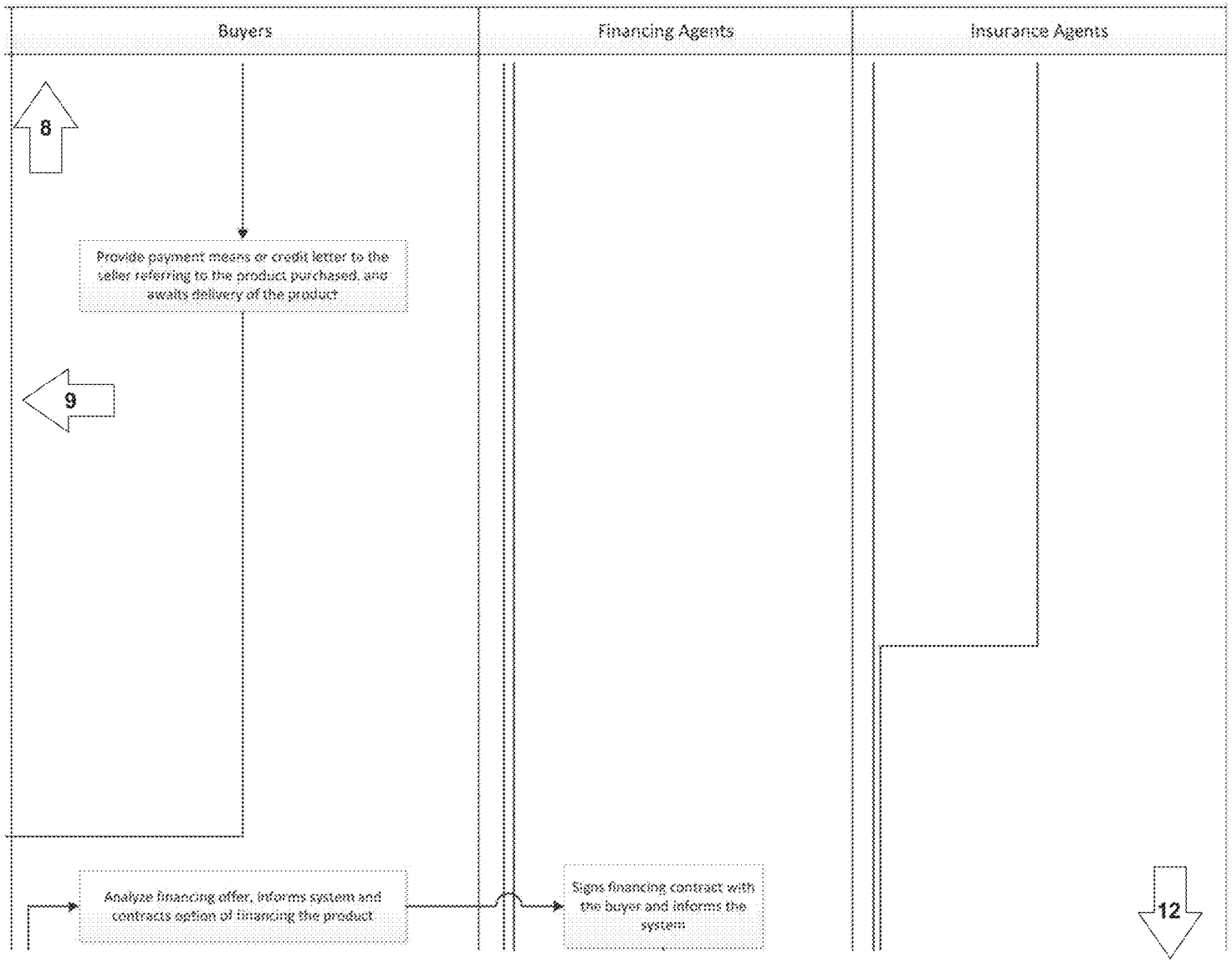
Figure 11:
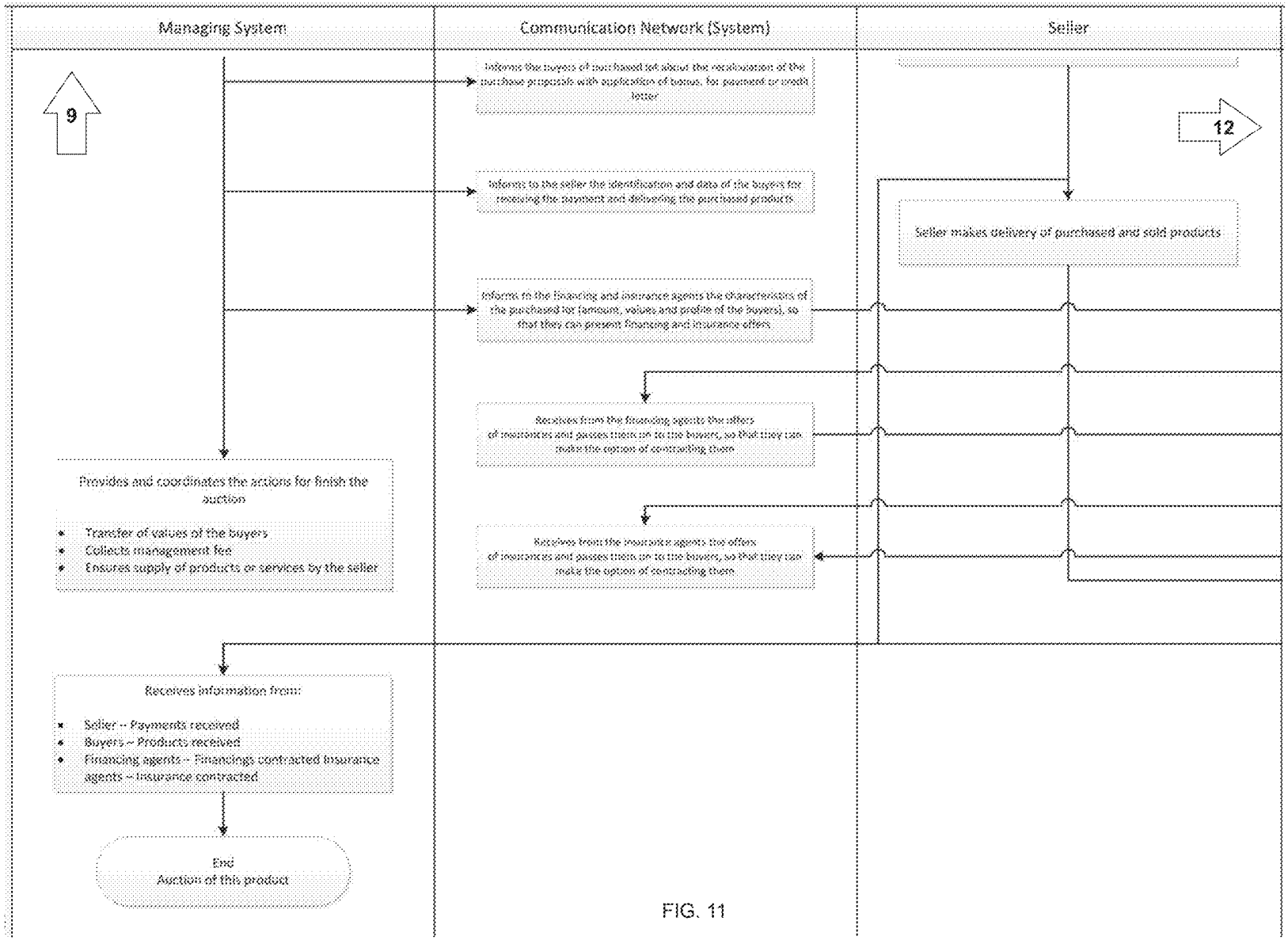
Figure 12:
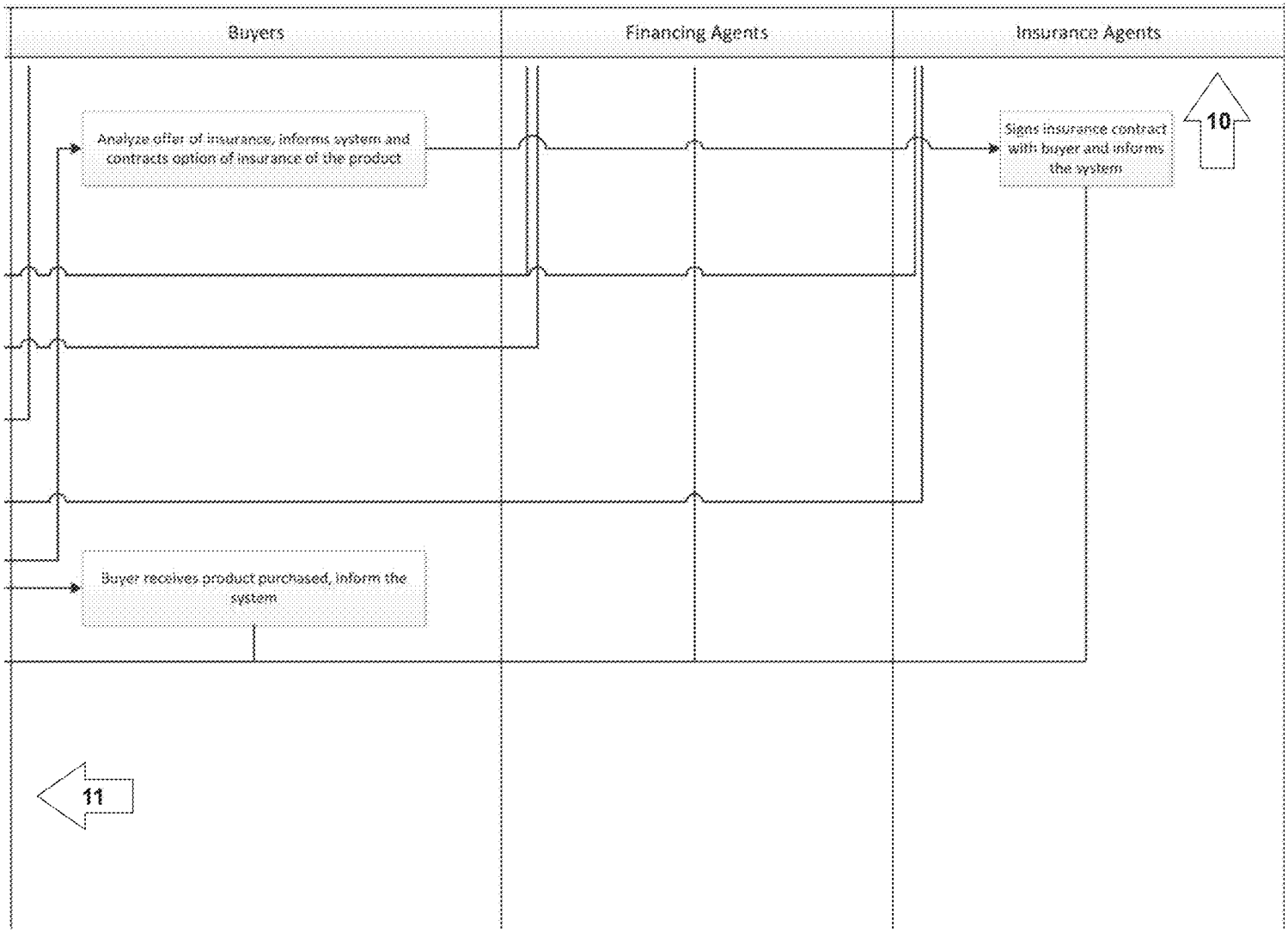

As described before, the invention provides a system for performing actions of an auction through a communication network 300, the system comprising a managing system 500, a plurality of buyers 200 and a plurality of sellers 100.

The communication network 300 basically comprises a dynamic database 310 and an Internet/Web interface, the database 310 being such as a Hard Disk Drive (HDD), a CD drive, memory cards, non-volatile storage chip (Electrically-Erasable Programmable Read-Only Memory EEPROM), Flash memory, or any other memory device capable of receiving, transmitting and storing data. The communication network 300 also comprises processing circuits for processing the data stored in the database 310.

The communication network 300 is connected to one or more external wireless or wired networks, such as a Personal Area Network (PAN), a Local Area Network (LAN), a Metropolitan Area Network (MAN), a Wide-Area Network (WAN), a Wireless Local Area Network (WLAN), among others.

The managing system 500 being connected to the database 310 and to the Internet/Web interface of the communication network 300.

The managing system 500 may be a user connected to a mobile or fixed terminal, such as a personal computer, a tablet, a cellular apparatus or any other responsible for the electronic coordination of the performance of actions of the auction through the communication network 300. In case the managing system 500 is a user, the latter may, for instance, coordinate the auction by means of a dedicated application.

The managing system 500 may also be autonomous and automatic, being, by means of processors, controllers, memories or any other electronic component capable of coordinating, by means of artificial intelligence, the performance of actions of the auction through the communication network 300.

The plurality of buyers 200 and the plurality of sellers 100 are connected to the database 310 and to the Internet/Web interface of the communication network 300 by means of a mobile or fixed terminal. The mobile or fixed terminal is a personal computer, a tablet, a cellular apparatus or any other terminal capable of connecting the plurality of buyers 200 and the plurality of sellers 100 to the communication network 300 by means of a dedicated application.

The plurality of buyers 200, the plurality of sellers 100 and the managing system 500 are connected with each other by means of a communication network 300. The plurality of buyers 200 and the plurality of sellers 100 communicate with the communication network 300 through wireless networks using a variety of protocols, such as IEEE 802.11 (Wi-Fi) wireless network, telecommunication networks 2G, 3G and 4G (General Packet Radio Service—GPRS/Universal Mobile Telecommunications System—UMTS/Wide Code Division Multiple Access—WCDMA/Long Term Evolution—LTE), Infrared Protocol, Bluetooth® or any other wireless network protocol.

The method and the system for performing actions of an auction of a product or service through the communication network 300 are initiated when the managing system 500 defines auction processing rules, conditions and guarantees, inclusion terms, alteration and exclusion of proposals/bids, definition of bonus percentage to be applied, among other rules that it deems to be necessary. These may be determined manually by the user connected through the mobile or fixed terminal to the communication network 300 or through the artificial intelligence. In the event of artificial intelligence, the electronic components are capable of collecting, for instance, data from the latest auctions carried out and determine which main rules should be defined in the present auction.

After determining the rules of the auction, the managing system 500 defines the category, the upset price and the base model of the product or service. All this information defined by the managing system 500 is sent to the communication network 300 and stored in the database 310.

The communication network 300 then processes the information defined and stored in the database 310. Once the information has been processed, the communication network 300 sends it to the plurality of sellers 100 and then informs a deadline to return the information.

Once the such information has been received, the plurality of sellers 100 selects a model and characteristics of the product or service that will better fall into the reference of the managing system 500, the plurality of sellers 100 then sends an offer 10 of product or service, such offer 10 comprising information on the product or service in this category and detailed characteristics of contents of the product or service offered.

Different offers 10 for the same initial reference price may be sent by the plurality of sellers 100, as for instance, cars of different brands, accessories, among others.

Said offer 10 is then received by the communication network 300 and stored in the database 310. The offer 10 sent by each of the sellers 100 is stored in the Internet/Web interface for the same initial reference price, the information of the offer 10 being made available for the plurality of buyers 200.

After storing the information in the Internet/Web interface, the managing system 500 posts this information in the website portal with access released to the public with all the information of product or service, and the plurality of sellers 100 may or may not have access to additional information prohibited to them.

The information of the product or service having been published, the plurality of buyers 200 accesses the website in order to start their participation in the auction.

If the plurality of buyers 200 is not registered in the website, the latter should fill their identification data and obtain approval from the managing system 500, the latter accounting for the analysis of the registration, issuance of contract terms and to approve each of the sellers 100, also the plurality of buyers 200, one or more financing agents 110 and/or one or more insurance agents 120.

All those who have access to the operational contents of the auction system should be previously registered and approved by the managing system 500 for verification of their qualifications.

If the financing agent 110 considers the plurality of buyers 200 to be of interest, he will present an offer of guarantee and financing, the latter having details and values of the financing to be incorporated as an offer to the plurality of buyers 200 together with the lot 30 to be bought. However, one observes that the offer of financing is an option presented to the plurality of buyers 200, the latter not having obligation to contract it.

If the insurance agent 120 considers the plurality of buyers 200 to be of interest, the latter presents an offer of insurance, either individual or in group, the latter having details and values of the insurance to be incorporated as offer to the plurality of buyers 200 together with the lot 30 to be taken. However, one observes that the offer of insurance is an option presented to the plurality of buyers 200, the latter not having obligation to contract for it.

If the plurality of buyers 200 is registered at the website, one should access it in order to verify and select the option of product or service of their interest. Selection can use or generate the offer 10 of the plurality of sellers 100. The plurality of buyers 200 should make a proposal of purchase/bid 20 to the product or service, the purchase/bid proposal 20 being determined for each offer 10 of each seller 100 and may present equal or different values for each offer 10.

As an example, the plurality of buyers 200 may give a first purchase/bid proposal 20 of R$35.000,00 in a first offer 10 for a car of a first seller 100, a second purchase/bid proposal 20 of R$33.000,00 in a second offer 10 for a car of a second seller 100 and a third purchase/bid proposal 20 of R$32.000,00 in a third offer 10 for a car of a third seller 10, the buyer 200 may present the offer 10 for one or more, or even for all the sellers 100.

The purchase/bid proposals 20 are then stored in the database 310 of the communication network 300, the latter being configured to group by offer of seller 100 and by value, monitor and process the purchase proposals 20 received.

The managing system 500 then processes and groups, in a dynamic manner and in real time, all the purchase proposals 20 received and determines the product or service matrix for the plurality of sellers 100 and number buyers 200 grouped by value attributed to each offer of the plurality of sellers 100.

One observes that, from the product or service matrix, the plurality of sellers 100 will have a general view of all the purchase proposals 20 given in all the offers 10. Moreover, the matrix illustrates individually a lot 30 for each seller 100, the lot 30 being determined by the communication network 300 and being constituted by the purchase proposals 20 received for each offer 10 of each seller 100.

The plurality of buyers 200 waits that one of the sellers 100 takes the lot 30 for his product or service, this lot being defined by the taking seller in the taking action.

The lot 30 is determined by the upset price which the seller 100 defines as being of his interest upon taking the lot 30, in this case with the sum of the purchase proposals 20 between this upset price and the maximum value received for each of the offers 10 of the seller 100 who buys his respective lot 30.

Since the plurality of sellers 100 have a global view of all the purchase proposals 20 for all the offers 10, the plurality of sellers 100 can decide the opportune moment for taking the lot 30 considered attractive.

The plurality of sellers 100 then analyzes their respective lot 30, taking into account the amount of product or service by values, the latter buying the lot 30 from a determined lot 30 of purchase proposals 20.

Still using the example of the car, the plurality of sellers 100 may take the lot 30 by criteria of minimum purchase proposals 20 of –32.000,00 (monetary units) up to the maximum value given for their offer 10.

Once the taken lot 30 has been considered attractive, the managing system 500 will communicate to all the participants in the auction, that is, to the plurality of buyers 200 and to the plurality of sellers 100, that lot 30 has been bought.

One observes that the plurality of sellers 100 who has bought lot 30 considered attractive will sell to the plurality of buyers 200 who gave the purchase proposals 20 in the minimum value ranges up to the highest value, within the criteria of the plurality of sellers 100 (purchase proposals 20 higher than 32.000,00). The purchase proposals for product or service of the plurality of buyers 200 who gave purchase proposals 20 below the criteria of the plurality of sellers 100 (purchase proposals 20 lower than R$32.000,00) will be disregarded.

As an alternative, after lot 30 has been bought, the managing system 500 may apply a bonus factor 50 ranging from 0% to 100% in the purchase proposals 20 of the product or service. Such a variable bonus factor 50 should be previously defined by the managing system 500 and disclosed to everybody before the beginning of the auction, said bonus 50 having the objective of approximating all the values of the bought lot to the purchase proposals 20 of the minimum purchase proposal 20 given in the bought lot 30. Such approximation is determined by the equation:

$$(PRmin+((1-B\ \%)*(PRL-min)),\ \text{wherein:}$$

PRmin corresponds to the value of the price range of lowest purchase proposal of the plurality of purchase proposals 20 of the respective lot 30 bought.

B % corresponds to the bonus percentage to be applied to the purchase proposal of the plurality of purchase proposals 20 higher than the lowest purchase proposal (by the calculation, the lowest purchase proposal remains in the same value), this reduction factor being determined by the managing system 500, and may range from 0% to 100%.

PRL corresponds to the value of the price range of the respective purchase proposal of the plurality of purchase proposals 20 in which the bonus is being applied.

If the managing system 500 determines that the bonus factor 50 should be "0%", one observes that a plurality of buyers 200 will buy the product or service of the lot 30 taken by their purchase proposal 20 given.

If the managing system 500 determines previously that the bonus factor should be "100%", one observes that all of the plurality of buyers 200 will buy the product or service of the lot 30 bought by the lowest purchase proposal 20 given.

In the face of the foregoing, one observes that the adoption of a bonus factor 50 is a choice of the managing system 500, which is in the "democratization" of taken values, and therefore a more fair system, managed according to the analysis and the advisability of the market, so that the application of said bonus factor 50 will be efficient.

After communication of the lot 30 bought, the managing system 500 will still be responsible for monitoring the transfer of values of the plurality of buyers 200 who bought the product or service of the lot 30 bought.

The managing system 500 additionally monitors the supply of the product or service of the plurality of sellers 100 to the plurality of buyers 200, and collects the auction managing fee.

The plurality of sellers 100 then provides the offered and sold product or service to be delivered, while the plurality of buyers 200 provides the payment of the bought product or service.

After the above steps have been carried out, the auction for the product or service is finished.

The advantage of using the method and the system set forth above is that one reaches an almost perfect market, where, unlike the real market, which has difficulty in bringing together a large number of buyers, this market has the ease of bringing them together.

Reminder: in the case of the perfect market, the following requirements should be met:

I) there must be a large number of sellers and buyers, where the individual decision of each will have little influence on the global market;

II) there must be homogeneity of the product or service, wherein all are equal to all the sellers;

III) there must be transparency, wherein the participants have full knowledge of the general conditions in which the market operates; and IV) there must be free access to information.

A preferred example of embodiment having been described, one should understand that the scope of the present invention embraces other possible variations, being limited only by the contents of the accompanying claims, which include the possible equivalents.

The invention claimed is:

1. A method for performing a competition among a plurality of sellers during actions of an auction of a product or service through a communication network, comprising the following steps:

a) connecting terminals of the plurality of sellers and terminals of a plurality of buyers between each other by means of the communication network;

b) sending, from the communication network to the terminals of the plurality of sellers, specifications of the product or service to be auctioned beginning at an initial reference price;

c) sending, from the terminals of the plurality of sellers to the communication network, a plurality of offers, wherein the plurality of offers include a plurality of models matching or closest to the specification and respectively defined by the managing system for the initial reference price, d) storing the plurality of offers in a database of the communication network;

e) processing the offers stored in the database in step d) by means of the communication network;

f) publishing in the website, to be accessed by a plurality of buyers, the specifications and an initial reference price of the product or service to be auctioned;

g) sending, from the terminals of the plurality of buyers to the communication network, a plurality of purchase proposals for the auctioned product or service, the plurality of purchase proposals being sent for each one of the plurality of offers of the plurality of sellers in step c), wherein the plurality of purchase proposals respectively include one or more proposal prices for the plurality of models;

h) storing the plurality of purchase proposals in the database of the communication network;

i) processing the purchase proposals stored in the database in step g) by means of the communication network;

j) generating, by means of the communication network, a product or service matrix from the data related to the plurality of offers and purchase proposals processed in steps e) and h);

k) generating, by means of the communication network, a plurality of lots of purchase proposals based on the product or service matrix generated in step j), wherein each of the plurality of lots correspond to one of the plurality of models;

l) sending, from the communication network to the terminals of the plurality of sellers, the plurality of lots generated in step j);

m) monitoring, in real time, which one of the terminals of the plurality of sellers exchanges data with the communication network to take the respective lot of the plurality of lots of purchase proposals, wherein the respective lot is generated when one of the plurality of sellers takes at least one purchase proposal, the lot being comprised by at least one purchase proposal taken seller and wherein said lot has a range comprised by a minimum upset price interesting to the seller and a highest price range for the purchase proposals corresponding to his model auctioned.

2. The method according to claim 1, wherein the communication network is the Internet, the terminals of the plurality of sellers and the terminals of the plurality of buyers being a mobile or fixed terminal.

3. The method according to claim 1, wherein at least two of the plurality of models have the same characteristics.

4. The method according to claim 1, wherein at least one of the plurality of models has different characteristics.

5. A method for performing a competition among a plurality of sellers during actions of an auction of a product or service through a communication network, comprising the following steps:

a) connecting terminals of the plurality of sellers, terminals of a plurality of buyers and a managing system among each other by means of the communication network;

b) sending, from the managing system to the terminals of the plurality of sellers, the specifications and an initial reference price for the product or service to be sold by auction;

c) sending, from the terminals of the plurality of sellers to the communication network, a plurality of offers for a plurality of products or services matching or closest to the specification to be sold by auction according to the specifications in step b), wherein the plurality of offers are offered at the initial reference price, d) storing the plurality of offers in a database of the communication network;

e) processing the offers stored in the database in step d) by means of the communication network;

f) publishing in the website, to be accessed by a plurality of buyers, the specifications and an initial reference price of the product or service to be auctioned;

g) publishing and sending the offers to the terminals of the plurality of buyers;

h) starting the auction and processing in real time, by means of the communication network, a plurality of purchase proposals received from each of the terminals of the plurality of buyers, wherein the plurality of purchase proposals respectively include one or more units per proposal price for the product or service;

i) grouping, by means of the communication network, the plurality of purchase proposals received in step g) according to the price range which each of the buyers of the plurality of buyers undertakes to pay for each respective product or service offered by each seller of the plurality of sellers;

j) storing the plurality of purchase proposals in the database of the communication network;

k) processing the purchase proposals previously stored in the database in step j) by means of the communication network;

l) generating, by means of the communication network, a product or service matrix from the data related to the plurality of offers and purchase proposals previously processed;

m) generating, by means of the communication network, a plurality of lots of purchase proposals based on the product or service matrix generated in step l), wherein each of the plurality of lots of purchase proposals correspond to one of the plurality of products or services;

n) sending, from the communication network to the terminals of the plurality of sellers, the matrix previously generated in step l;

o) monitoring, in real time, which one of the terminals of the plurality of sellers exchanges data with the communication network to take a new lot, wherein the lot is generated when the seller takes at least one purchase proposal, the lot being comprised by at least one purchase proposal taken by one of the plurality of sellers and wherein said lot is determined by the range comprised by a minimum value interesting to the seller and the highest value for the purchase proposals corresponding to his model auctioned.

6. The method according to claim 5, wherein each terminal of the plurality of buyers sends the plurality of purchase proposals of the products in offer, through the communication network, for one or more terminals of the plurality of sellers.

7. The method according to claim 6, wherein two or more purchase proposals of the plurality of purchase proposals sent by each of terminals of the plurality of buyers are of equal value for the respective products offered by each of the terminals of the respective sellers.

8. The method according to claim 6, wherein two or more purchase proposals of the plurality of purchase proposals sent by each of terminals of the plurality of buyers are of a differentiated value for the respective products offered by each of the terminals of the respective sellers.

9. The method according to claim 6, wherein the taken of the respective lot by one of the terminals of the plurality of sellers comprises:

defining the upset price which one seller of the plurality of sellers defines and undertakes to accept up to the lowest value of the purchase proposal of the plurality of purchase proposals, which includes all the purchase proposals of the plurality of purchase proposals with values attributed to their product in this value range;

disregarding automatically all the purchase proposals of the plurality of purchase proposals with values lower than the upset (lowest) price taken by the one of the terminals of the plurality of sellers;

disregarding all the other sellers of the plurality of sellers participating in the auction of said product or service.

10. The method according to claim 5, wherein the communication network is the Internet, the terminals of the plurality of sellers and the terminals of the plurality of buyers being a mobile or fixed terminal.

11. The method according to claim 5, wherein at least two of the plurality of models have the same characteristics.

12. The method according to claim 5, wherein at least one of the plurality of models has different characteristics.

13. A system for performing a competition among a plurality of sellers during actions of an auction of products or services through a communication network, comprising:

terminals of a plurality of buyers and terminals of the plurality of sellers, the terminals of the plurality of buyers and the terminals of the plurality of sellers being connected to each other by means of the communication network, the communication network being configured to receive, from the terminals of the plurality of sellers, a plurality of offers for the product or service and a plurality of purchase proposals from the terminals of the plurality of buyers for each one of the plurality of offers for the product or service, wherein the plurality of offers set by the plurality of sellers, for the product or service include a plurality of models matching or close to the specification respectively offered by two or more of the plurality of sellers, for the same initial reference price, and the communication network compiling, in real time, so as to list individually or group all the proposals of the plurality of units corresponding to the purchase proposals sent by the terminals of the plurality of buyers for each product or service offered by each of the terminals of the plurality of sellers according to the price which each of the buyers of the plurality of buyers undertakes to pay for each product or service offered by each of the sellers of the plurality of sellers;

the communication network further being configured to store, in a database, the plurality of offers and the plurality of purchase proposals;

the communication network processing the plurality of offers and the plurality of purchase proposals, the communication network generating a product or service matrix from the processed data related to the plurality of offers and purchase proposals and generating a plurality of lots of purchase proposals based on the generated product or service matrix, wherein each of the plurality of lots of purchase proposals correspond to one of the plurality of models;

the communication network sending the generated matrix to the terminals of the plurality of sellers and monitoring, in real time, the terminals of the plurality of sellers exchanging data with the communication network to take a new lot, wherein the respective lot is generated when one of the plurality of sellers takes at least one purchase proposal, the lot being comprised by at least one purchase proposal taken by the plurality of sellers and wherein said lot is determined by the range comprised by a minimum value interesting to the seller and the highest value for the purchase proposals corresponding to his model auctioned.

14. The system according to claim 13, wherein the communication network is configured to process and compile, by grouping, the plurality of purchase proposals, determining the total of purchase proposals per price range for each of the plurality of sellers.

15. The system according to claim 14, wherein the communication network disregards all the purchase proposals of the plurality of purchase proposals sent by all the terminals of the plurality of buyers who sent the plurality of purchase proposals lower than the lowest price took by one of the terminals of the plurality of sellers.

16. The system according to claim 15, wherein the plurality of buyers of the respective lot are all those included in the range bought by one of the plurality of sellers who took the respective lot.

17. The system according to claim 16, wherein the plurality of purchase proposals of the lot auctioned is adjusted after definition of the lowest value range of the respective lot auctioned with a discount previously defined by the managing system.

18. The system according to claim 17, wherein the discount (bonus) to be applied after the lowest price range of the respective lot has been known is previously defined and disclosed by the managing system, prior to the start of the auction, to all the participants of the auction of the product or service.

19. The system according to claim 18, wherein the discount is defined and disclosed before the auction is calculated by a percentage ranging from 0% (zero percent) to 100% (a hundred percent), at the discretion of the managing system, considering the market variables and for better efficiency and performance of the auction.

20. The system according to claim 19, wherein the discount is the result of the calculation: (PRmin)+((1−B %)*(PRL−PRmin)), wherein:

PRmin corresponds to the upset price range or unit, defined and accepted by the seller of the product or service related to the lot;

B % corresponds to a bonus factor to be applied to the purchase proposals of the lot, equal or higher than the upset price, defined and accepted by the seller of the plurality of purchase proposals by the calculation, wherein the lowest upset price will be a fixed value, wherein B % may be configured as a reduction factor predetermined before the start of the auction by the managing system, and may range from 0% to 100%;

PRL corresponds to the proposals within the highest price defined and accepted by the seller of the plurality of the plurality of purchase proposals in the taken lot to which the bonus factor is applied.

21. The system according to claim 13, wherein the communication network is the Internet, the terminals of the plurality of sellers and the terminals of the plurality of buyers being a mobile or fixed terminal.

22. The method according to claim 13, wherein at least two of the plurality of models have the same characteristics.

23. The method according to claim 13, wherein at least one of the plurality of models has different characteristics.

24. A system for performing a competition among a plurality of sellers during actions of an auction of products or services through a communication network, comprising:

a) a managing system, terminals of a plurality of buyers and terminals of the plurality of sellers, the managing system, the terminals of plurality of buyers and the terminals of plurality of sellers being connected among each other by means of the communication network, b) the communication network being configured to receive, from the managing system, the specification of product or service and an initial reference price to be sent to the terminals of the plurality of sellers, c) the communication network being configured to receive, from the terminals of the plurality of sellers, a plurality of offers that are in accordance or close to the specifications and the initial reference price for the product or service sent to the terminals of the plurality of buyers, d) the communication network further being configured to store, in a database, the specifications and the initial reference price for the plurality of offers sent by the terminals of the plurality of sellers, e) the communication network publishing on the Internet and sending the data stored in the database of the communication network referring to the plurality of offers sent by the terminals of the plurality of sellers according to the specifications and the initial reference price, f) the communication network further being configured to receive, from the terminals of the plurality of buyers, a plurality of purchase proposals for the purchase of the product or the service, wherein the plurality of purchase proposals respectively include one or more proposal prices for the plurality of models, g) the communication network compiling, in real time, so as to listing individually or group all the proposals of the plurality of units corresponding to the purchase proposals sent by the terminals of the plurality of buyers for each product or service offered by each of the terminals of the plurality of sellers according to the price which each of the buyers of the plurality of buyers undertakes to pay for each product or service offered by each of the sellers of the plurality of sellers, h) the communication network further being configured to store, in a database, the plurality of offers and the plurality of purchase proposals;

i) the communication network processing the plurality of offers and the plurality of purchase proposals;

j) the communication network generating a product or service matrix from the processed data related to the plurality of offers and purchase proposals and generating a plurality of lots of purchase proposals based on the generated product or service matrix, wherein each of the plurality of lots of purchase proposals correspond to one of the plurality of models;

k) the communication network sending the matrix to the terminals of the plurality of sellers and monitoring, in real time, which one of the terminals of the plurality of sellers exchanges data with the communication network to take a new lot of the plurality of lots of purchase proposals, wherein the respective lot is generated when the seller takes at least one purchase proposal, the lot being comprised by at least one purchase proposal taken by the seller and wherein said lot is determined by the range comprised by a minimum value (upset price) interesting to the seller and the highest value for the purchase proposals corresponding to his model auctioned.

25. The system according to claim 24, wherein the communication network is configured to determine the real price of the plurality of purchase proposals distributed per price range and the amount of products or services of the respective lot taken by the seller of the plurality of sellers.

26. The system according to claim 25, wherein:

the communication network disregards the plurality of purchase proposals sent by the terminals of the plurality of buyers who sent a purchase proposal lower than a minimum purchase proposal in the respective lot took by one of the plurality of sellers the communication network disregards the plurality of purchase proposals of sent by the terminals of the plurality of buyers who sent purchase proposals for the other sellers of the plurality of sellers who did not take the respective lot.

27. The system according to claim 26, wherein terminals of the plurality of buyers who gave the plurality of purchase proposals included in the respective lot will purchase the product or service from the one seller of the plurality of sellers who took the respective lot.

28. The system according to claim 27, wherein the terminals of the plurality of buyers included in the purchased lot has taken the product or service from the one seller who took the lot by the price adjusted with application of the bonus in the plurality of purchase proposals given by the terminals of the respective buyer in the purchased lot.

29. The system according to claim 24, wherein the communication network is the Internet, where the managing system makes available to the terminals of the plurality of sellers and to the terminals of the plurality of buyers access to the communication network by means of a mobile or fixed terminal.

30. The system according to claim 24, wherein the managing system discloses to potential registered suppliers of complementary products or services related to the products and services that are the object of the auction with the respective specifications of the products and services put up for sale by the terminals of the plurality of sellers.

31. The system according to claim 30, wherein the managing system informs the potential registered suppliers of complementary products and services about the amount of products and services taken, so that they can present proposals to supply such products and services.

32. The system according to claim 31, wherein the managing system, after having received the offers of the suppliers of the products and services related to the products at auction sends such offers on to the terminals of the plurality of buyers, so that they will contract them since they present advantages relating to the volume of the products and services offered.

33. The system according to claim 32, wherein the plurality of buyers makes the option of contracting or purchasing the complementary products or services, negotiated in lot through notification to the managing system which, in turn, will pass them on to the suppliers of complementary products or services.

34. The system according to claim 30, wherein the suppliers of products or services are financing agents that offer financing services and that additionally are guarantors of the financing operation.

35. The system according to claim 34, wherein the potential suppliers of products or services may supply or incorporate complementary products to the products or services bought by the plurality of buyers.

36. The system according to claim 30, wherein the suppliers of products or services are insurance agents that provide insurance service and that additionally are guarantors of the conditions of use of the product.

37. The method according to claim 24, wherein at least two of the plurality of models have the same characteristics.

38. The method according to claim 24, wherein at least one of the plurality of models has different characteristics.

39. A system for performing a competition among a plurality of sellers during actions of an auction of products or services through a communication network, comprising:

terminals of a plurality of buyers and terminals of the plurality of sellers, the terminals of the plurality of buyers and the terminals of the plurality of sellers being connected to each other by means of the communication network, the communication network being configured to receive, from the terminals of the plurality of sellers, a plurality of offers for the product or service and a plurality of purchase proposals from the terminals of the plurality of buyers for each one of the plurality of offers for the product or service, wherein the plurality of offers includes a model matching or close to the specification set by two or more of the plurality of sellers, for the same initial reference price, the communication network compiling, in real time, so as to list individually or group all the proposals of the plurality of purchase proposals sent by the terminals of the plurality of buyers for each product or service offered by each of the terminals of the plurality of sellers according to the price range or unitary which each of the buyers of the plurality of buyers undertakes to pay for each product or service offered by each of the sellers of the plurality of sellers;

the communication network further being configured to store, in a database, the plurality of offers and the plurality of purchase proposals, the communication network processing the plurality of offers and the plurality of purchase proposals, the communication network generating a product or service matrix from the processed data related to the plurality of offers and purchase proposals and generating a plurality of lots of purchase proposals based on the generated product or service matrix, wherein each of the plurality of lots of purchase proposals correspond to one of the plurality of models;

the communication network sending the generated plurality of lots of purchase proposals to the terminals of the plurality of sellers and monitoring, in real time, which one of the terminals of the plurality of sellers exchanges data with the communication network to take a new lot of purchase proposals, wherein the respective lot is generated when the seller takes at least one purchase proposal, the lot being comprised by at least one purchase proposal taken by the seller and wherein said lot is determined by the range comprised by a minimum value (upset price) interesting to one of the plurality of sellers and the highest price range the purchase proposals corresponding to his model auctioned of the lot, wherein the communication network disregards all the purchase proposals of the plurality of purchase proposals sent by all the terminals of the plurality of buyers who sent the plurality of purchase proposals lower than the lowest price took by one of the terminals of the plurality of sellers, wherein the communication network is configured to process and compile, listing individually or by grouping, the plurality of purchase proposals, determining the total of units included in the purchase proposals per nominal or range price for each of the plurality of sellers for the taken of the respective lot, the plurality of buyers of the respective lot being all those included in the range taken by one of the plurality of sellers who took the lot, the plurality of purchase proposals of the prices of the respective lot is adjusted after definition of the lowest price the respective lot taken with a discount (bonus) previously defined by the managing system.

40. The system according to claim 39, wherein the discount to be applied after the lowest price range of the respective lot has been known is previously defined and disclosed by the managing system, prior to the start of the sale offer, to all the participants of the sale offer of the product or service.

41. The system according to claim 39, wherein the discount defined and disclosed before the auction is calculated by a percentage ranging from 0% to 100% at the discretion of the managing system, considering the market variables and for better efficiency and performance of the auction.

42. The system according to claim 39, wherein the discount is the result of the calculation: (PRmin)+((1−B %)*(PRL−PRmin)), wherein:

PRmin corresponds to the upset price range or unit, defined and accepted by the seller of the product or service related to the lot;

B % corresponds to a bonus factor to be applied to the purchase proposals of the lot, equal or higher than the upset price, defined and accepted by the seller of the plurality of purchase proposals by the calculation, wherein the lowest upset price will be a fixed value, wherein B % may be configured as a reduction factor predetermined before the start of the auction by the managing system, and may range from 0% to 100%;

PRL corresponds to the purchase proposals within the highest price defined and accepted by the seller of the plurality of the plurality of purchase proposals in the taken lot to which the bonus factor is applied.

* * * * *